US005383291A

United States Patent [19]

Schmitt

[11] Patent Number: 5,383,291

[45] Date of Patent: Jan. 24, 1995

[54] PRESSING MACHINE WITH LINEAR OBLIQUE AND VERTICAL STROKES

[75] Inventor: Werner Schmitt, Mömbris, Germany

[73] Assignee: Brisay Maschinen-GmbH, Aschaffenburg, Germany

[21] Appl. No.: 181,788

[22] Filed: Jan. 18, 1994

[30] Foreign Application Priority Data

Jan. 19, 1993 [DE] Germany ..... 9300634

[51] Int. Cl.[6] ..... D06F 71/14

[52] U.S. Cl. ..... 38/31

[58] Field of Search ..... 38/16, 28, 30, 31, 35, 38/42, 43; 100/93 P, 214, 219, 226

[56] References Cited

U.S. PATENT DOCUMENTS

| | | | |
|---|---|---|---|
| 1,078,394 | 11/1913 | Warner | 38/28 |
| 1,967,082 | 7/1934 | Emery | 38/31 |
| 2,023,895 | 12/1935 | Malott, Jr. | 38/25 |
| 2,041,009 | 5/1936 | Matthews | 38/35 |
| 2,307,370 | 1/1943 | Hale | 38/16 X |
| 2,832,159 | 4/1958 | Frick | 38/30 |
| 2,954,619 | 10/1960 | Foster | 38/30 |
| 4,280,290 | 7/1981 | Andersson | 38/25 |

FOREIGN PATENT DOCUMENTS

| | | | |
|---|---|---|---|
| 0378221 | 7/1990 | European Pat. Off. | 38/30 |
| 378221 | 7/1990 | European Pat. Off. . | |
| 1256615 | 12/1967 | Germany . | |

*Primary Examiner*—Clifford D. Crowder
*Assistant Examiner*—Ismael Izaguirre
*Attorney, Agent, or Firm*—Foley & Lardner

[57] ABSTRACT

A pressing machine includes a bottom form, onto which pressing material is laid from an operating side, and a top form which can be lowered onto the bottom form and which can be lifted off from the bottom form. There is a guide for the top form, by which guide the top form, without a substantial change in its spatial orientation, is moved, in a first stroke, out of an initial position obliquely downwards towards the operating side over the bottom form. The top form is then lowered onto the bottom form essentially at right angles, and, in a second stroke, is lifted off from the bottom form essentially at right angles and is then moved obliquely upwards away from the operating side into the initial position.

8 Claims, 3 Drawing Sheets

PRESSING MACHINE WITH LINEAR OBLIQUE AND VERTICAL STROKES

BACKGROUND OF THE INVENTION

The invention relates to a pressing machine and method, with a bottom form, onto which pressing material is laid from an operating side, and with a top form which can be lowered onto the bottom form and which can be lifted off from the bottom form.

It is known, in pressing machines of this type, to tilt the top form rearwards and upwards from the operating side, to lay the pressing material onto the bottom form and then to pivot the top form onto the bottom form towards the operating side and press it onto the bottom form. With the top form swung up, the operator is exposed to thermal radiation up to head height. During the pivoting of the top form onto the bottom form, momentum is transmitted from the top form to the pressing material and is absorbed by the pressing material, with the result that highly sensitive pressing material can be damaged.

SUMMARY OF THE INVENTION

An object of the invention is, while ensuring generous free space for the operator for the purpose of laying on and removing the pressing material, to protect the operator against thermal radiation, especially at head height, and to make it possible to press even highly sensitive pressing material without damage.

These and other objects and advantages of the invention are achieved by a pressing machine, comprising a stand; a bottom form located on the stand for receiving pressing material from an operating side of the pressing machine; a top form which is lowered onto and lifted off of the bottom form; and a guide for moving the top form, without a substantial change in a spatial orientation of the top form, in a first stroke from a first position obliquely downwards towards the operating side to a second position above the bottom form and then lowering the top form essentially vertically downward onto the bottom form, and, in a second stroke, lifting the top form essentially vertically upward off the bottom form to a third position above the bottom form, and then obliquely upwards away from the operating side to the first position.

The guide preferably comprises a supporting device for supporting the top form; arms, attached obliquely to the supporting device, for obliquely guiding the top form; a bracket for supporting the arms above the stand; and a linear motor for displacing the arms; wherein the arms are displaceable in their longitudinal direction relative to the bracket by means of the linear motor.

The guide preferably further comprises essentially vertical rods for connecting the top form to the supporting device, and a second linear motor for displacing the essentially vertical rods, wherein the essentially vertical rods are displaceable in their longitudinal direction relative to the supporting device by means of the second linear motor.

The inventive method of pressing comprises the steps of providing a pressing machine having top and bottom forms; moving the top form, without a substantial change in its spatial orientation, from a first position obliquely downwards towards an operating side of the pressing machine to a second position above the bottom form; lowering the top form essentially vertically downward onto the bottom form; lifting the top form essentially vertically upward off the bottom form to a third position; and moving the top form from the third position obliquely upwards away from the operating side to the first position.

Other objects, features, and advantages of the invention will become apparent from the following detailed description taken in conjunction with the attached drawings.

BRIEF DESCRIPTION OF THE DRAWINGS

The invention is described below by means of an exemplary embodiment with reference to the accompanying drawings. The drawings are hereby expressly made a part of the specification.

DETAILED DESCRIPTION OF THE PREFERRED EMBODIMENTS

The pressing machine is defined by a guide for the top form, by means of which the top form, without a substantial change in its spatial orientation, is to be moved, in a first stroke, out of an initial position obliquely downwards towards the operating side over the bottom form and is then to be lowered onto the bottom form essentially at right angles, and, in a second stroke, is to be lifted off from the bottom form essentially at right angles and is then to be moved obliquely upwards away from the operating side into the initial position.

Designs which can be implemented especially simply in terms of construction and which can be controlled in a simple way are explained in further detail herebelow.

The pressing machine according to the exemplary embodiment has a stand 2. Next to the operating side 4 of the stand 2 a bottom form 6 is supported. Pressing material is to be laid onto the bottom form 6 from the operating side 4. A top form 8 can be lowered onto the bottom form 6 and can be lifted off from the bottom form 6 and serves for pressing.

Figure 1:
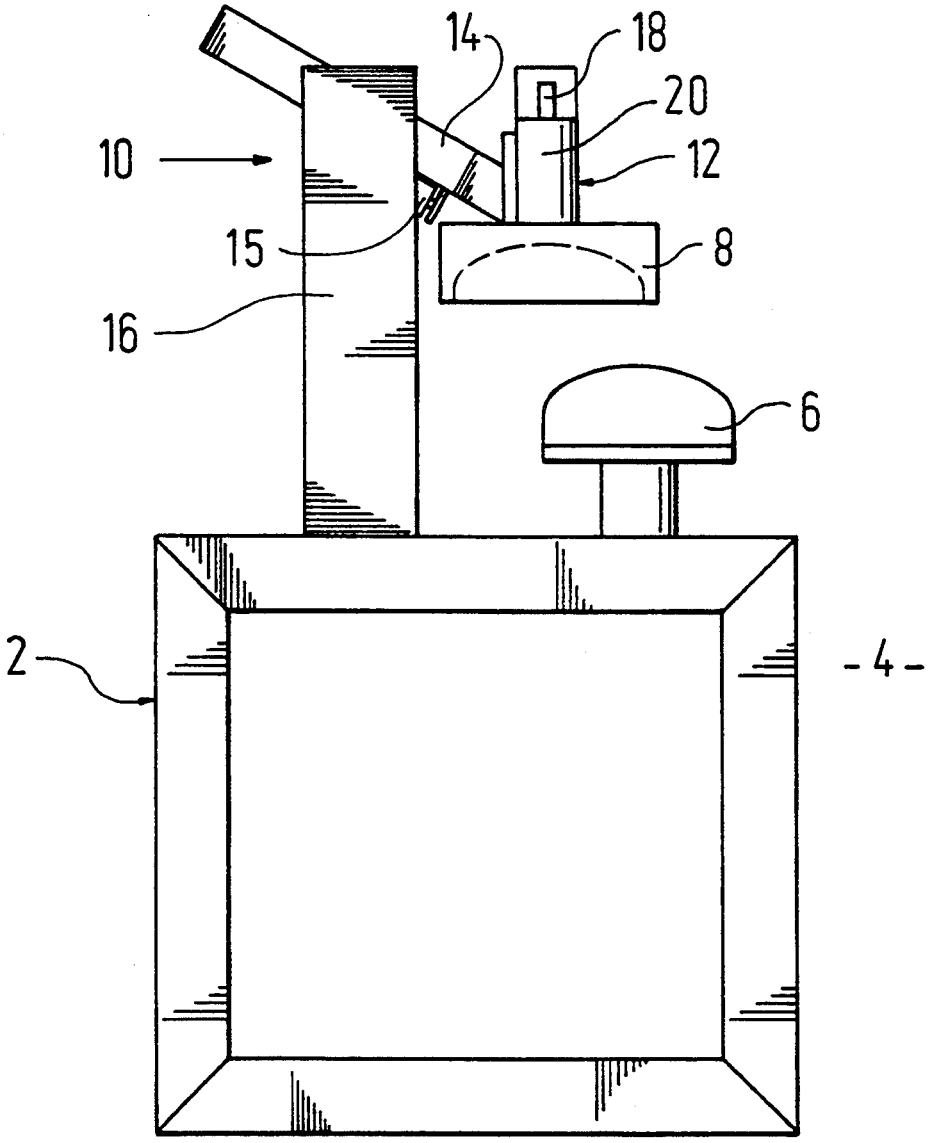
FIG. 1 shows a side view of a pressing machine, with the top form lifted off from the bottom form and set aside by the operator.
Figure 2:
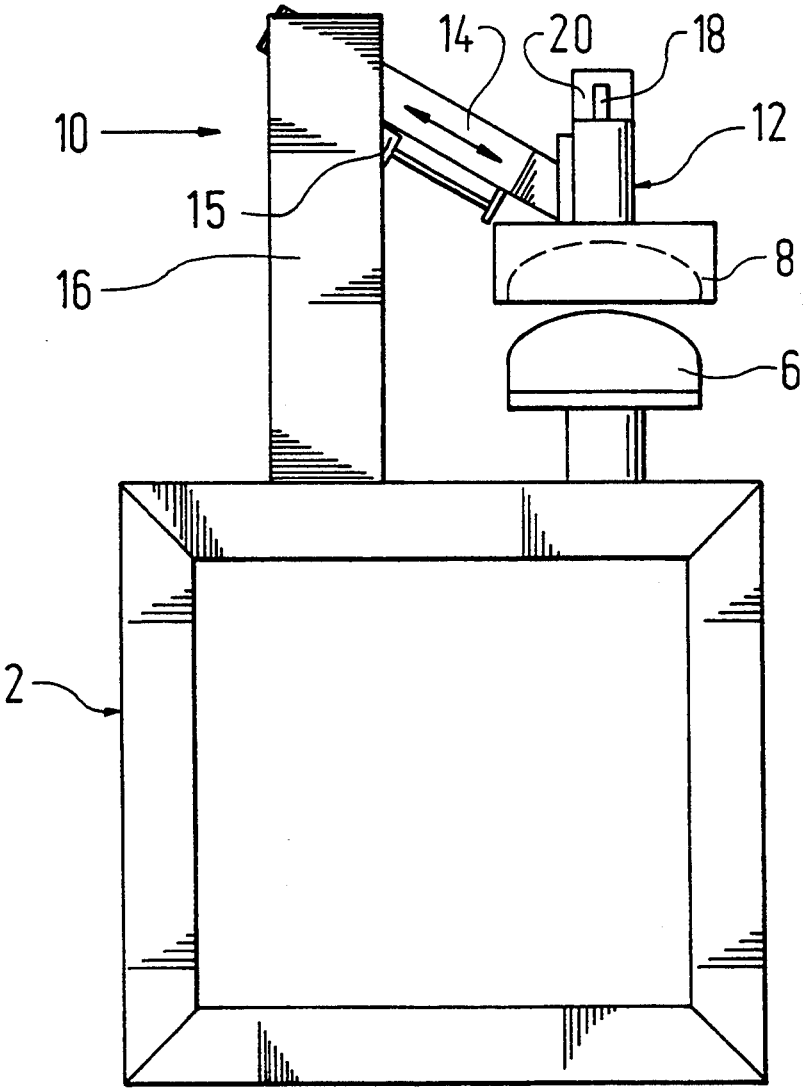
FIG. 2 shows the pressing machine according to FIG. 1, with the top form lowered relative to the operator to a point over the bottom form.
Figure 3:
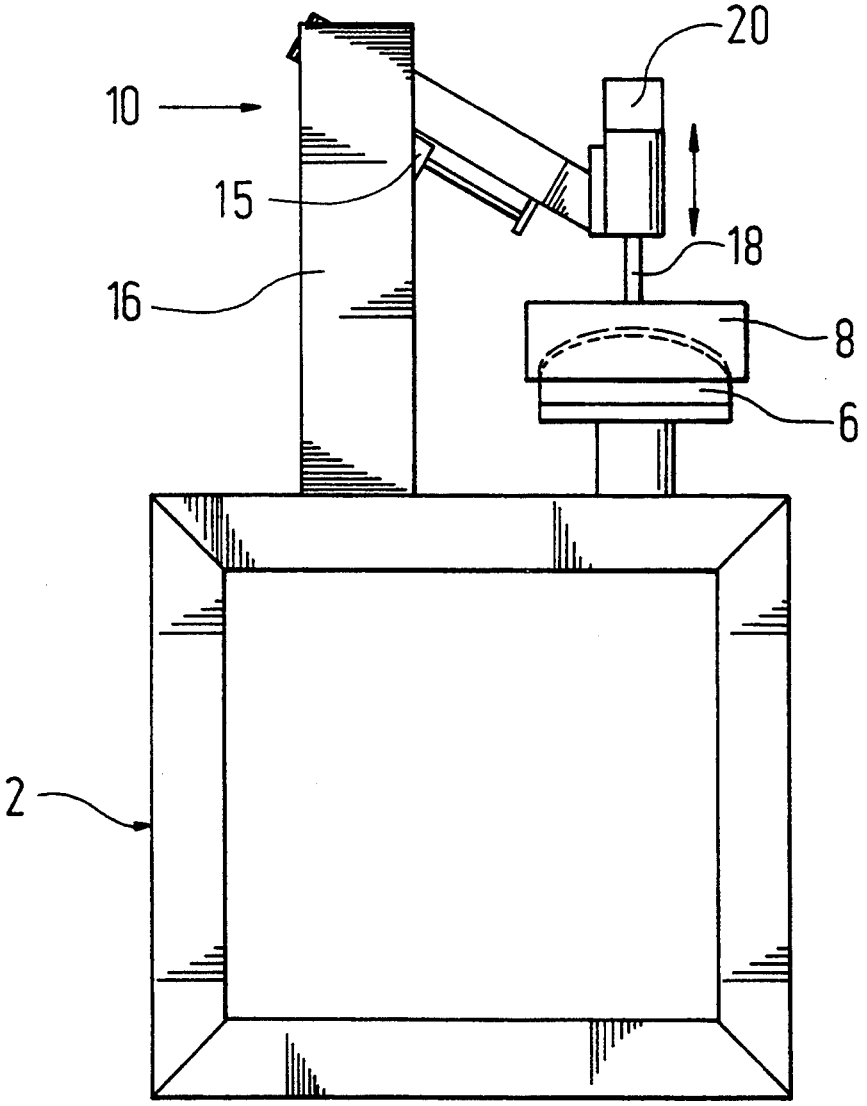
FIG. 3 shows the pressing machine according to FIG. 1, with the top form pressed onto the bottom form.

By means of a guide 10, the top form 8, without a substantial change in its spatial orientation, is to be moved, in a first stroke, out of an initial position (FIG. 1) obliquely downwards towards the operating side 4 over the bottom form 6 (FIG. 2) and is then lowered onto the bottom form 6 essentially at right angles (essentially vertically) (FIG. 3). The top form is moved without a substantial change in its spatial orientation so that the top form maintains its essentially horizontal orientation, thereby minimizing the exposure of the operator to thermal radiation. Conversely, in a second stroke, the top form 8 is to be lifted off from the bottom form 6 essentially at right angles and is then to be moved obliquely upwards away from the operating side 4 into the initial position (FIG. 1). The top form maintains an essentially horizontal orientation as it moves obliquely upwards away from the operating side 4 into the initial position.

The laying on of the pressing material takes place in the state according to FIG. 1. As is evident, the free space for the operator for carrying this out is generous.

At the same time, the top form 8 radiates heat downwards, that is to say, not towards the operator. The lowering of the top form onto the bottom form out of the state according to FIG. 2 can be carried out in a controlled manner, in such a way that the pressing material is not damaged. No momentum occurs while this is taking place.

For the oblique guidance of the top form 8, arms 14 are attached obliquely to a supporting device 12 of the top form 8 and are guided displaceably in their longitudinal direction on the stand in a bracket 16. The displacement takes place by means of piston/cylinder units or linear motors 15 which are supported on the bracket 16 and on the arms 14. For vertical guidance, the supporting device 12 is connected to the top form 8 by means of essentially vertical piston rods 18 which are displaceable in their longitudinal direction relative to the supporting device 12 by means of piston/cylinder units or linear motors 20 located in the supporting device 12.

Although the invention has been described with reference to certain preferred embodiments, numerous variations, alterations, and modifications to the preferred embodiments may be made without departing from the spirit and scope of the appended claims, and equivalents thereof.

What is claimed is:

1. A pressing machine, comprising:

a stand;

a bottom form located on the stand for receiving material to be pressed from an operating side of the pressing machine;

a top form which is lowered onto and lifted off of the bottom form; and a guide for moving the top form, in a first stroke from a first position linearly and obliquely downwards towards the operating side to a second position above the bottom form and then in a second stroke from the second position linearly vertically downward onto the bottom form to a third position and, in a third stroke, lifting the top form linearly vertically upward off the bottom form from the third position to a fourth position above the bottom form, and then in a fourth stroke obliquely upwards away from the fourth position to the first position.

2. The pressing machine of claim 1, wherein the guide further comprises:

a supporting device for supporting the top form;

arms having a longitudinal direction and attached obliquely to the supporting device;

a bracket for supporting and guiding the arms above the stand; and a linear motor for displacing the arms relative to the bracket in their longitudinal direction.

3. The pressing machine of claim 2, wherein the guide further comprises:

vertical rods having a longitudinal direction and attached at their lower ends to the top form; and a second linear motor for displacing the vertical rods in their longitudinal direction relative to the supporting device.

4. The pressing machine of claim 1, wherein the second and third positions are a same position.

5. A method of pressing, comprising the steps of:

providing a pressing machine having top and bottom forms;

moving the top form, from a first position linearly and obliquely downwards towards an operating side of the pressing machine to a second position above the bottom form;

lowering the top form linearly vertically downward onto the bottom form to a third position;

lifting the top form linearly vertically upward off the bottom form to a fourth position; and moving the top form from the fourth position linearly and obliquely upwards away from the operating side to the first position.

6. The method of claim 5, wherein the lifting step includes the step of lifting the top form to a fourth position that is a same position as the second position.

7. The method of claim 5, wherein the first recited moving step includes the step of moving the top form so that the top form maintains an essentially horizontal orientation.

8. The method of claim 5, wherein the second recited moving step includes the step of moving the top form so that the top form maintains an essentially horizontal orientation.

* * * * *